US007591939B2

(12) United States Patent
Benham

(10) Patent No.: US 7,591,939 B2
(45) Date of Patent: Sep. 22, 2009

(54) INTEGRATED DESULFURIZATION AND FCC PROCESS

(75) Inventor: Kelly Benham, Calgary (CA)

(73) Assignee: Stone & Webster Process Technology, Inc., Houston, TX (US)

( * ) Notice: Subject to any disclaimer, the term of this patent is extended or adjusted under 35 U.S.C. 154(b) by 304 days.

(21) Appl. No.: 11/158,846

(22) Filed: Jun. 22, 2005

(65) Prior Publication Data

US 2005/0284796 A1 Dec. 29, 2005

Related U.S. Application Data

(60) Provisional application No. 60/581,900, filed on Jun. 22, 2004.

(51) Int. Cl.
*C10G 69/04* (2006.01)
*C10G 11/18* (2006.01)
*C10G 17/095* (2006.01)

(52) U.S. Cl. ..... 208/61; 208/89; 208/113; 208/208 R

(58) Field of Classification Search ..... 208/46, 208/49, 58, 61, 67, 106, 113–124, 177, 208 R, 208/89
See application file for complete search history.

(56) References Cited

U.S. PATENT DOCUMENTS 2,737,479 A 3/1956 Nicholson
2,878,891 A 3/1959 Ross
3,074,878 A 1/1963 Pappas
3,835,029 A 9/1974 Larson
4,276,150 A * 6/1981 McHenry, Jr. ..... 208/120.25
4,288,235 A 9/1981 Gartside et al.
4,298,460 A 11/1981 Fujimori et al.
4,348,364 A 9/1982 Gartside et al.
4,756,886 A 7/1988 Pfeiffer et al.
4,961,863 A 10/1990 Van Den Akker et al.
5,259,855 A 11/1993 Ross, Jr. et al.
5,310,477 A * 5/1994 Lomas ..... 208/78
5,837,129 A 11/1998 Ross, Jr. et al.
6,113,777 A 9/2000 Gauthier et al.
6,692,552 B2 * 2/2004 Benham ..... 208/161
2003/0121824 A1 7/2003 Wang et al.

OTHER PUBLICATIONS

C.W. Kuehler and A. Humphries, Meeting Clean Fuels Objectives with the FCC, Nat'l Petrochemical & Refiners Assn. (Mar. 2003).*
C.W. Kuehler, "Meeting clean fuel objectives with the FCC," NPRA Annual Meeting, Mar. 23, 2003, Washington, DC, pp. 1-17.
A. A. LAPAS, "The effect of catalyst properties on the in situ reduction of sulfur in FCC gasoline, " Applied Catalysis A: General 262, Nov. 12, 2003, pp. 31-41.

* cited by examiner

*Primary Examiner*—Glenn Caldarola
*Assistant Examiner*—Randy Boyer
(74) *Attorney, Agent, or Firm*—Locke Lord Bissell & Liddell LLP; Alan B. Clement; Peter J. Fallon

(57) ABSTRACT

The present invention is describes a novel technique for producing commercial hydrocarbon materials using a fluid catalytic cracking unit employing recycling of light cycle oil in combination with desulfurization catalysts.

16 Claims, 15 Drawing Sheets

REACTION PATHWAYS

INTEGRATED DESULFURIZATION AND FCC PROCESS

CROSS REFERENCE TO RELATED APPLICATION

This application claims the benefit of U.S. Provisional Patent Application No. 60/581,900, filed Jun. 22, 2004.

FIELD AND BACKGROUND OF THE INVENTION

The shift to the production of ultra clean fuels and chemicals from refineries combined with a focus on minimizing greenhouse gases warrants revisiting the integration of the fluid catalytic cracking unit (FCCU) within a conventional refinery setting. Evolving technologies can allow refiners to restructure their processing and phase into the heteroatom free products demanded by the marketplace. Additive technology, such as RESOLVE®, can be utilized both in the transition process allowing for additional time for directions in the market to become clearer and structurally as part of an integrated solution. Integration of improved desulfurization catalyst technology directly into the design of the FCCU offers the potential to simplify the refinery processing scheme and provide some interesting advantages in many applications.

In Canada, between July 2002 and Jan. 1, 2005, refiners were required to meet an interim average gasoline sulfur specification of 150 wppm (parts per million by weight). Starting Jan. 1, 2005, the specification was lowered to 30 wppm. The phasing in of the gasoline sulfur specifications will be followed by a distillate maximum sulfur specification of 15 wppm on Jun. 1, 2006. This has resulted in a critical examination of the effectiveness of different approaches and future product demands.

From a refiner's perspective, there are a significant number of unknowns in moving forward with capital expenditures. What appears to be an obvious solution today may not be tomorrow. Evolving technologies both to produce and utilize the products significantly may change the demand and product slate from the refineries. The push forward into a hydrogen economy may not happen as quickly as many have anticipated. In North America a shift from gasoline to distillate may not occur. Practical solutions for making the transition to more environmentally friendly products may be achievable with the industry's base infrastructure.

Feedstock quality also will influence the refining infrastructure. For example, evolving technologies allow for low hydrogen and high sulfur content tar sands bitumen to be viable feedstocks. Tar sands provide a long term security of supply. Infrastructure built into the primary upgrading will influence how a refiner adapts by reconfiguring refining complexes to process feedstocks derived from tar sands.

General Criteria for the Evolution Are:

1. Effective utilization of hydrogen and the subsequent balancing of carbon in the products in any configuration
2. Energy efficiency
3. Reduction of $CO_2$ generation
4. Reduction of gaseous and particulate emissions The FCCU is a carbon rejection and hydrogen transfer device. The FCC process tailors the carbon distribution based on the hydrocarbon structures in the feedstock and the drive towards equilibrium in the cracking process. Historically, the FCCU has been viewed as a relatively inexpensive gasoline and light olefin generator that now has significant application as a residual oil upgrader. FCCU and their constituent parts are well known in the art, examples of FCCU can be found in U.S. Pat. Nos. 2,737,479; 2,878,891; 3,074,878; 3,835,029; 4,288,235; 4,348,364; 4,756,886; 4,961,863; 5,259,855; 5,837,129; 5,837,129; 6,113,777 and 6,692,552.

With improvement of bulk desulfurizing efficiency within the FCCU process, the FCCU could fill a role as a pseudo hydrocracker operation. The process would generate high olefinicity liquefied petroleum gas (LPG), a low carbon number high hydrogen content stream for fuel cells, a low hydrogen content alkylbenzene stream for chemicals, and a tailored narrow boiling cycle oil that is significantly easier to integrate into existing refinery hardware. Optionally, the cycle oil could be eliminated completely negating the need for additional hydrogen and associated energy and $CO_2$ generation. The FCCU would retain its carbon rejection flexibility.

Tailoring the FCCU product distribution to eliminate the 330° F. to 430° F. boiling range improves the quality of the gasoline, eliminates or reduces subsequent processing costs, and drops the driveability index of FCCU gasoline from about 1300 to 1000. Lower values of the driveability index mean improved cold-start and warm-up performance.

Further tailoring of the FCCU product distribution to remove the 600° F. to 700° F. cut eliminates the sterically hindered LCO components that are very difficult to hydrotreat. Ideally, these low hydrogen content components could be utilized as coke and eliminate the hydrogen, energy, and capital required to upgrade this stream into the high hydrogen content fuels.

The 700° F.+FCCU slurry has a niche in heavy oil upgrading and coke related products. The high boiling nature of the FCCU slurry allows it to act as a liquid catalyst in some heavy oil upgrading processes.

In recent times, hydrocarbon catalytic cracking processes increasingly employ a system whereby the hydrocarbon feedstock is cracked in the presence of a high activity cracking catalyst in a riser-type reactor. In general the FCC process proceeds by contacting hot regenerated catalyst with a hydrocarbon feed in a reaction zone under conditions suitable for cracking; separating the cracked hydrocarbon gases from the spent catalyst using a gross cut separator followed by conventional cyclones; steam stripping the spent catalyst to remove hydrocarbons and subsequently feeding the stripped, spent catalyst to a regeneration chamber where a controlled volume of air is introduced to burn the carbonaceous deposits from the catalyst, and returning the regenerated catalyst to the reaction zone.

In order to prevent overcracking, after transit of the reactor, it is desirable to quickly make a gross cut separation of the catalyst from the cracked products. In this regard, the industry has produced many different types of separation devices for effecting the gross cut separation. See, e.g., U.S. Pat. Nos. 2,737,479; 2,878,891; 3,074,878; 4,288,235; 4,348,364; 3,835,029; 4,756,886; 5,259,855; 4,961,863; 5,837,129; 6,113,777; among others. An especially useful device, for use in the prior art and in the present invention is the Riser Termination Device (RTD), which is described and claimed in Benham, U.S. Pat. No. 6,692,552.

The use of the more efficient of these known separators, such as those described in U.S. Pat. Nos. 4,288,235; 5,837,129 and 6,113,777, and especially the RTD (U.S. Pat. No. 6,692,552), results in efficient disengaging of spent catalyst and product vapors, thereby reducing non-selective post-riser reactions and resulting in low gas make and delta coke. The RTD separator system has an integrated degassing system to reduce further the amount of hydrocarbon that reaches the stripper. The unit coke balances in these systems have been maintained by blending the base feedstocks with coker slurry, heavy fuel oil (HFO) or vacuum tower bottoms (VTB) (the undistilled fraction in a vacuum distillation) to adjust coke and slurry precursor levels of between 10 and 16 weight percent. The units typically operate with delta cokes of about 0.6 weight percent resulting in catalyst to oil ratios in the 8 to 10 range.

Additionally, it has been known that certain feedstocks to FCC units can be pretreated to remove sulfur, such as by hydrotreating, as is known to those skilled in the art. With the improved separator systems, especially those providing improved stripping prior to entry of the catalyst into the dense catalyst bed in the disengaging vessel, such as with the RTD bathtub system (described in the aforementioned U.S. Pat. No. 6,692,552), certain heat balance problems have arisen. In solving the problems of the prior art, the present inventor first has established differentiation criteria for the sulfur in gasoline behavior of feedstocks. The criteria are based on the bulk aromatic sulfur content of the FCC feedstock. Using these criteria, the present inventor has found:

(1) interaction from feedstocks generally accepted as being non-reactive results in shifts in heteroatom concentrations and carbon distribution. Blending of these feedstocks with the bulk FCC feed results in reduced heteroatom content of the FCC product as well as a redistribution of the carbon number and the hydrogen of the net FCC product that is very advantageous.

(2) a very direct impact on catalyst (including most significant results from gasoline sulfur reduction additive published to date) influence on the gasoline sulfur concentrations in the process.

(3) the ability to relate the aromatic sulfur content of feedstocks in such a system so that they can be segregated and processed appropriately.

(4) $H_2S$ and olefin recombination are hypothesized to be the primary reaction system to control thiophenes as further focused on in the severe hydrotreated feedstock lab work-up and the $C_5$-$C_6$ co-processing work. In particular, the characteristics of the RTD significantly reduce the amount of these materials passing from the reactor into the stripper system as well as reduce the length of time these materials are in contact with each other in the riser. Sulfur reduction additives for use in FCC units are well known to those skilled in the art. Particularly beneficial additives for use in the practice of the present invention are those sold by Akzo Nobel under the trademark RESOLVE®. It is believed by the present inventors that the use of sulfur reduction additives in the practice of the present invention are more particularly beneficial in FCC units employing the RTD separator system due to its more efficient degassing. Use of the RTD system provides less control on the sulfur contributed from the aromatic sulfur species in the feedstock, but significantly more influence on the thiophenes and mercaptans generated in the FCC unit from the olefin and $H_2S$ recombination.

Processing severely hydrotreated feedstocks or very low aromatic sulfur feedstocks in modern FCC units, especially those employing the RTD system, has proved difficult because coke and slurry precursor levels may be insufficient to generate a comfortable heat balance. Table I below shows general feedstock properties in this regard.

TABLE I

| | Sweet Gas Oil | HT#1 | HT#2 | HT#3 | Tar Sands HT | Syncrude Bottoms |
|---|---|---|---|---|---|---|
| % HT | 0 | 90.7 | 92.9 | 97.3 | 99.1 | 99.5+ |
| Density | 0.896 | 0.891 | 0.891 | 0.891 | 0.909 | 0.895 |
| ACE Conversion (wt %) | 78.3 | 86.6 | 86.3 | 87.9 | 82.4 | 86.1 |
| Precursors (wt %) | | | | | | |
| Gasoline | 79.5 | 85.9 | 85.7 | 87.0 | 85.2 | 90.4 |
| LCO | 9.7 | 7.12 | 7.12 | 6.61 | 7.27 | 5.02 |
| Coke and slurry | 10.8 | 6.96 | 7.13 | 6.41 | 7.52 | 4.59 |
| Wt % boiling <650° F. | 24.6 | 0 | 0 | 0 | 0 | 0 |
| Aromatic sulfur (wt %) | 2.78 | 0.69 | 0.65 | 0.73 | 1.80 | 1.01 |
| Benzothiophenes | 1.08 | 0.09 | 0.03 | 0.06 | 0.54 | 0.18 |
| Dibenzothiophenes | 1.38 | 0.51 | 0.62 | 0.62 | 1.18 | 0.80 |
| Tribenzothiophenes | 0.32 | 0.09 | 0.00 | 0.06 | 0.08 | 0.02 |
| Sulfur (wppm) | 7182 | 743 | 561 | 215 | 200 | 65 |
| CFHTU LHSV | NA | 1.5 | 0.8 | 0.8 | 0.50 | 1.0 |
| Gasoline sulfur (wppm) | 698 | 26 | 26 | 19 | 8 | 16 |
| Light cut (183 F.–) | 44.7 | 6.0 | 3.5 | 3.0 | 1.5 | 1.5 |
| Mid cut (183-350 F.) | 369.1 | 13.7 | 16.9 | 13.3 | 5.6 | 11.4 |
| Thiophene | 54 | 6.5 | 6.5 | 6.0 | 2.5 | 6.0 |
| Thiophene (% mid cut) | 15 | 48 | 39 | 45 | 44 | 53 |
| Heavy cut (350-430) | 284.6 | 6 | 6 | 3 | 1.5 | 1.5 |
| Benzothiophene | 208.6 | 6 | 6 | 3 | 1.5 | 1.5 |
| Benzothiophene (% heavy cut) | 73.3 | 100 | 100 | 100 | 100 | 100 |
| Gasoline sulfur (% feed sulfur) | 9.7 | 3.5 | 4.8 | 8.9 | 4.0 | 24.0 |
| LCO S (430-650) wppm | 21977 | 2607 | 2386 | 1008 | 425 | 232 |
| LCO S (% feed sulfur) | 306 | 351 | 425 | 469 | 213 | 357 |
| HCO S (650+ F.) wppm | 13997 | 2338 | 2500 | 1041 | 100 | 100 |
| HCO S (% feed sulfur) | 195 | 315 | 446 | 484 | 50 | 154 |

The base feedstock is a representative virgin crude gas oil mix containing about 24.6 volume percent material boiling below 650F. Hydrotreated gas oils #1-3 represent three levels of hydrotreating of the base gas oil using variations in LHSV and operating temperature. All hydrotreated gasoils are cut at 650F. The desulfurization of the 650F plus conventional gas oil ranged from 90.7 to 97.3 percent and the hydrotreated feed sulfur ranged from 743-215 wppm.

Full range gasoline sulfur ranged from 26 to 19 wppm with most of the sulfur in the 183 to 350 F mid cut. The percentage of the feed sulfur routed to the gasoline increased with increased feedstock desulfurization in the CFHTU pilot plant.

The net desulfurization efficiency for the two tar sands sourced gasoils is over 99%. The gasoline sulfur for the 2700 psi hydrocracker bottoms is 24% of feed sulfur. The cycle oil sulfur concentration is higher relative to the base sweet gasoil feedstock in all the cases except the low LHSV 1900 psi tar sands operation. The elevated thiophenes and the reduced benzothiophenes are mercaptans in all the hydrotreated cases suggest the sulfur formed is undergoing recombination reactions with the olefins and generating the majority of the thiophenes and alkylthiophenes. The cracking studies for all the feedstocks indicate that the thiophene concentration in the gasoline increases with conversion.

The data suggest the minimum sulfur level that can be achieved by increasing the feed desulfurization level will be limited until the cycle oil sulfur levels are reduced sufficiently. Alternatively, to achieve very low gasoline sulfur levels, the FCCU would have to be set up to inhibit the olefin and $H_2S$ recombination reaction.

The novel approach taken by the present inventor unexpectedly was built on the advantages of the more efficient riser disengager systems to rapidly separate riser products, especially the RTD system. The condensed aromatics produced by the FCC unit cracking process are recovered from the fractionation system and injected into the stripper to generate coke to adjust the unit heat balance. This second stage cracking system is added below the first separator, e.g., RTD in the top of the conventional stripper. The introduction of light cycle oil (LCO), a fraction of FCC product liquid distilling between about 400° F. and about 700° F., (or an alternate fuel) into the long contact, high catalyst to oil, dense bed cracking system is targeted to convert the majority of the low hydrogen LCO stream into coke. The high cat/oil ratio (in the range of about 100), combined with very low levels of coke on the catalyst entering the dense bed contacting zone also enhances the reduction of sulfur by use of the sulfur reduction additive (such as RESOLVE®) for the non-coked vapors generated from the LCO and routed to product recovery.

For example, the Petro-Canada FCCUs employ a proprietary Riser Termination Device (RTD) developed by Petro-Canada and licensed by Shaw Stone and Webster, which results in efficient disengaging of catalyst and product vapors. Non-selective post-riser reactions are minimized resulting in low gas make and delta coke. The RTD system has an integrated degassing system to minimize the amount of hydrocarbon reaching the stripper. The unit coke balances typically have been maintained by blending the base feedstocks with coker slurry, HFO or VTB to adjust coke and slurry precursor levels of between 10 and 16 wt %. The units typically operate with delta cokes of about 0.6 wt % resulting in cat/oils in the 8 to 10 range.

In order to process severely hydrotreated feedstocks or very low aromatic sulfur feedstocks, adjustments have to be made to the FCCU processing scheme. Coke and slurry precursor levels are insufficient to generate a comfortable heat balance with some of these very low aromatic sulfur feedstocks.

The approach taken by Petro-Canada was to build on the advantages of the efficient riser disengager system to rapidly separate riser products. The condensed aromatics produced by the FCCU cracking process are recovered from the fractionation system and injected into the stripper to generate coke to adjust the unit heat balance. This second stage cracking system is added below the RTD in the top of the conventional stripper. The introduction of the LCO into the long contact, high cat to oil, dense bed cracking system is targeted to convert the majority of the low hydrogen LCO stream into coke. The high cat/oil ratio (in the range of 100) combined with very low levels of coke on the catalyst entering the dense bed contacting zone should enhance the reduction of sulfur by the RESOLVE® additive for the non-coked vapors generated from the LCO and routed to product recovery. By removing the dependency of the FCCU on coke generated from feedstock contact in the riser, the application of FCCU process is broadened to encompass a wide range of feedstocks.

This novel integrated process configuration provides many processing advantages, such as:

(1) Independent heat balance control for a fuel deficient system. As an example, this allows for decoupling the catalytic feed hydrotreating unit (CFHTU) severity effect on the fluid catalytic cracking unit (FCCU) heat balance from the CFHTU product desulfurization target. The gasoil sulfur is tied directly to the desulfurization level achieved on the other products and the conversion achieved in the CFHTU or hydrocracker. This allows for decoupling the requirements to achieve a higher coke and slurry containing feedstock from the FCCU from the hydroprocessor design criteria. This will allow for simplification of the hydroprocessor.

(2) Lower delta coke in the riser providing more selective catalytic processing at higher catalyst activity.

(3) Rapid separation of the olefin and $H_2S$ at the end of the riser that reduces sulfur recombination reactions.

(4) Utilization of the low hydrogen content product for fuel and providing sufficient time for the polyaromatic coke to be formed from the light cycle oils.

(5) Partitioning of the olefin exiting the riser from the sulfur contained in the fuel charged to the stripper to minimize sulfur recombination reactions.

(6) Ability to process higher sulfur content feedstocks and process higher aromatic sulfur feedstocks.

(7) Co-processing of low carbon number feedstocks for improved net carbon distribution, heteroatom removal and hydrogen management.

(8) Bulk processing of a wider range of feedstocks in the FCCU and the associated elimination of the complexity and efficiency of additional processing steps.

(9) Segregation of feedstock based on aromatic sulfur content.

(10) Direct disposal of low quality, high aromatic sulfur feedstocks, such as coker slurry in the second stage system.

Moreover, the integration of recycle streams from the main fractionator provides further process advantages, including, but not limited to:

(1) Tailored carbon distribution product and flexibility in hydrogen production within the refinery.

(2) Isolation of low hydrogen content aromatics produced in first pass cracking so that they can be exposed to severe cracking at long residence time and very high cat/oil ratios.

(3) Sulfur and nitrogen removal as polar compounds preferentially are converted to coke.

(4) Enhancement of the sulfur reduction efficiency of the sulfur reduction additive technologies, such as, but not limited to, the RESOLVE® technology.

(5) Energy efficiency.

DETAILED DESCRIPTION OF THE INVENTION

Figure 1:
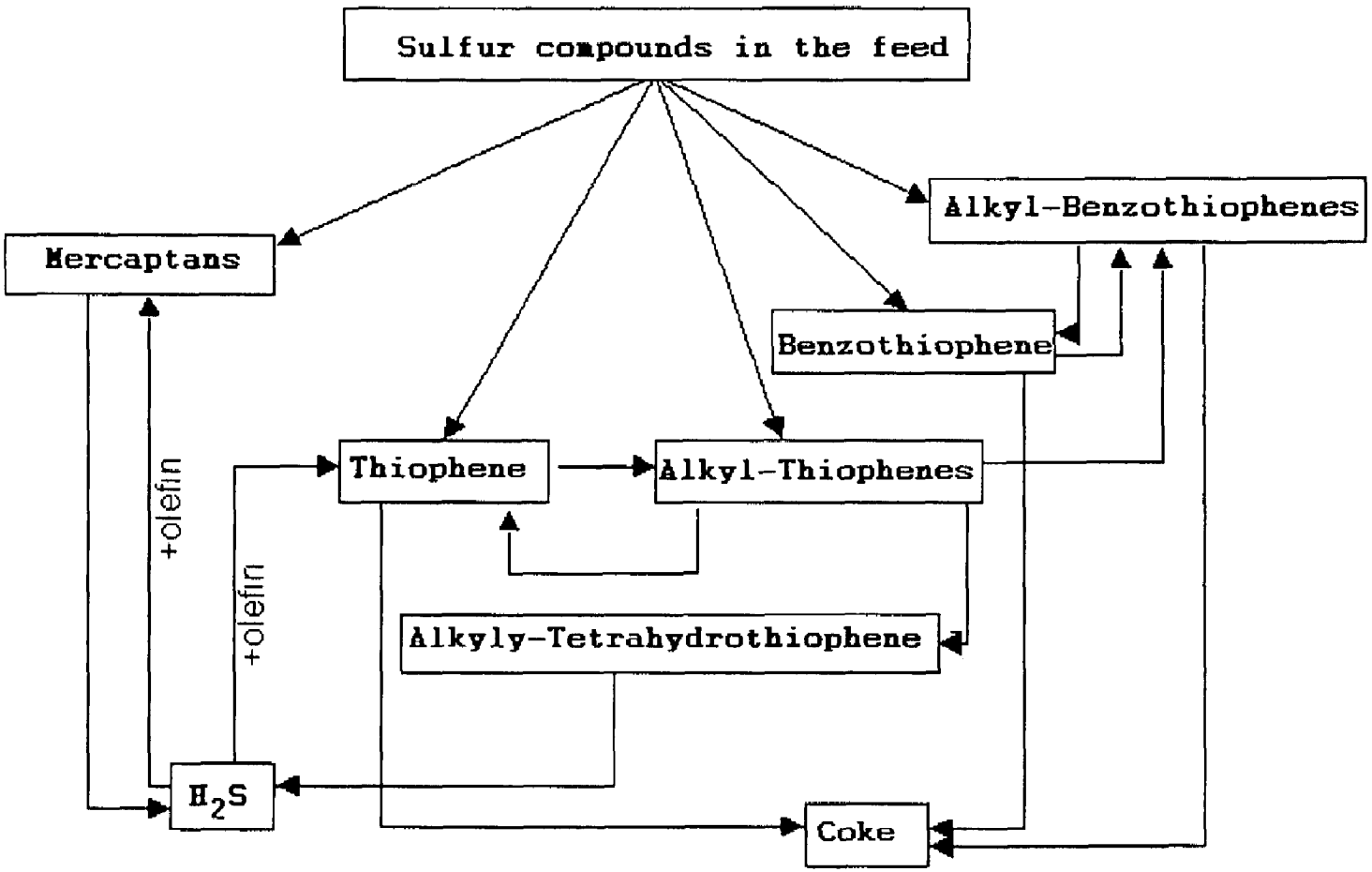
FIG. 1 is a diagram of the reaction pathways by which sulfur containing compounds form different compounds.

The technology of the present invention integrates variations in the FCCU process that allows refineries more efficiently to produce ultraclean fuels and chemicals. Distinctions with a hydrocracking approach increasingly become blurred. Utilizing a combination of carbon rejection, carbon distribution tailoring, hydrogen transfer and significantly improved heteroatom removal, simplifies the processing scheme, improves the refinery energy efficiency and significantly improves the hydrogen balance.

Hydrogen management in FCC units continues to be a major issue. Elimination of the FCCU heavy gasoline and cycle oils in the present invention reduces the need for subsequent processing, hydrogen and energy utilization. Elimination of the FCCU 165° C.+ naphtha also offers benefits in terms of providing an improved 100+N+2A naphtha reformer feedstock and allows for flexibility to increase the crude unit naphtha cut point to generate more hydrogen.

Efficient desulfurization of low aromatic sulfur-containing feedstocks within the FCC unit reduces or eliminates the need for gasoline post treatment with conventional processes and positions the product for simple low energy utilization final clean-up approaches. Octane losses associated with post-treatment options also are eliminated and the reduced end-point heavy naphtha generated by the FCCU is an improved feed for processes such as "heart cut reforming." Alternatively, pretreatment (e.g., CFHTU) severities for poorer quality FCCU feedstocks can be reduced with the associated lower hydrogen and capital requirements.

Use of sulfur reduction additives in the process of the present invention, such as those in the RESOLVE® line of additives, achieves significantly higher levels of sulfur reduction for low aromatic content feedstocks in addition to providing improved cracking activity and yield benefits. RESOLVE® is a well-known gasoline sulfur reduction agent. RESOLVE® is a high rare-earth zeolite composition that accomplished sulfur reduction on active Lewis acid sites. It is sold by Albermarle in several grades, notably, RESOLVE® 700, RESOLVE® 750, RESOLVE® 850 and RESOLVE® 950. Also see Humphries, A., Kuehler, C., *Meeting Clean Fuels Objectives with the FCC*, AM-03-57, NPRA Annual Meeting, San Antonio, Tex., 2003.

Further improvements in desulfurization efficiency or simply migration to elevated quantities in the FCCU circulating inventory are further applications for the processing approach of the present invention to poorer quality feedstocks.

The ability to crack distillates into low sulfur gasolines and subsequently separate out the low hydrogen content of aromatics provides a route to phase into the hydrogen fuel cell market. As the fuel cell market evolves, the process of the present invention provides improvements in the quality of the gasolines generated during this interim period. The present invention also will facilitate the integration of the increased volume of feedstocks derived from tar sands into the refining system.

More efficient use of the low hydrogen content bottom of the barrel feedstocks can be achieved through the slurry phase reaction system of the present invention. This system allows for adjusting the hydrogen injection into the heavy aromatics of poor feedstocks and provides the FCCU with a reasonable combination of feedstock precursors, hydrogen and heteroatoms to accomplish the same advantages as with conventional feedstocks. Accordingly, the process of the present invention can be extended to deasphalting and thermal cracking technology ahead of the slurry phase reaction system.

Petro-Canada operates three refining complexes in Canada. Each of these three refineries has significantly different configurations and operating objectives. Technology development and infusion of phased capital over a number of years provided sequential steps on the four FCCUs in moving towards a bulk processing configuration described herein.

The Petro-Canada Edmonton refinery is located in western Canada. This refinery is landlocked and has a development plan based on replacing the depleted conventional crude with locally produced tar sands bitumen and synthetic crudes derived from the tar sands. One of the crude trains in this refinery has operated since 1983 on 100% synthetic crude produced by Syncrude Canada in nearby Fort McMurray. Due to the very low hydrogen and high sulfur and nitrogen content of the bitumen to be processed going forward, the base technology selected to achieve the 2005 low sulfur gasoline target was a 1900 psi (CFHTU).

As part of the CFHTU integration work, the Edmonton FCCU catalyst was migrated to a mix of 90% HORIZON® 57 and 10% RESOLVE® 750 from 100% HORIZON® 57. HORIZON® 57 catalyst is based on Albemarle's TOPAZ® technology. RESOLVE® 750 is a component of the RESOLVE® desulfurization technology. This change provided a 26% reduction in gasoline sulfur for the 150 wppm phase in period and an equilibrated catalyst sample consistent with the rest of the Petro-Canada operations to serve as the basis for pilot plant development work. The results of this pilot work with Albemarle on a wide range of CFHTU feedstocks are discussed herein and illustrate an extension of the process of the present invention.

In eastern Canada, Petro-Canada operates a refining complex in Montreal. This facility is the largest asphalt producer in eastern Canada. A large proportion of the crude slate is asphaltic sourced offshore. The technology implemented to achieve the 2005 low sulfur gasoline target was IFP Prime G. FCCU gasoline sulfur reduction hardware was incorporated directly into the FCCU in 1998 as part of the methodology used to phase in expansion of that unit.

In central Canada, Petro-Canada operates a relatively simple refinery in Oakville that supplies gasoil to a Petro-Canada lubes and white oil producing complex. The Oakville refinery has two crude units and two small FCCUs. Similar to many small North American refineries, an excessively large capital expenditure was projected to upgrade the refinery to produce low sulfur fuels using conventional technologies.

The approach taken for the Oakville Refinery was to meet the shorter-term 150 wppm sulfur phase down with further development and implementation of FCCU based technologies. Alternate supply options would be utilized to meet the local market demand when the more stringent gasoline specifications came into effect January 2005. In 2002, Petro-Canada modified the Oakville #1 FCCU with a project very similar to the 1998 Montreal work. The design also incorporated the ability to send a heavy naphtha (HN) recycle stream to a 700 psig distillate desulfurization unit (DDS) and return the vapor and gasoline from the DDS stabilizer tower back to the FCCU.

Parallel developments on the four Petro-Canada FCCUs allowed for a platform to further develop the FCCU operation discussed above. The two Oakville FCCUs have been used to benchmark the RESOLVE® 750, 850 and 950 systems in hardware systems that allowed a wide range of interactive conversion and product distillation combinations and also process a wide range of feedstocks. The Edmonton and Montreal FCCUs compliment this database with additional hardware and feedstock variations. All four units have operated with a common base catalyst system and are equipped with the Petro-Canada RTD system.

As has been well documented in the literature, the FCCU contributes over 90% of the sulfur in an FCCU based refinery gasoline pool. FIG. 1 shows the reaction pathways postulated for the creation of sulfur species in the gasoline boiling range. By analogy, sulfur species will be generated in the other FCCU products through recombination of $H_2S$ with olefins or molecular rearrangement during cracking. Petro-Canada has done pilot plant studies using model compounds to develop a model for relative coking rates and sulfur distributions. This work confirms the potential for addressing cycle oil sulfur and quality issues within the FCCU process.

The two key objectives for adjusting the sulfur reaction pathways to enable the FCCU to be a more efficient bulk desulfurizer and hydrogen management tool are:

1. reduce the potential for olefin and $H_2S$ recombination.
2. increase the potential for thiophenes and thiophenes in aromatic complexes to be converted to coke.

Figure 2:
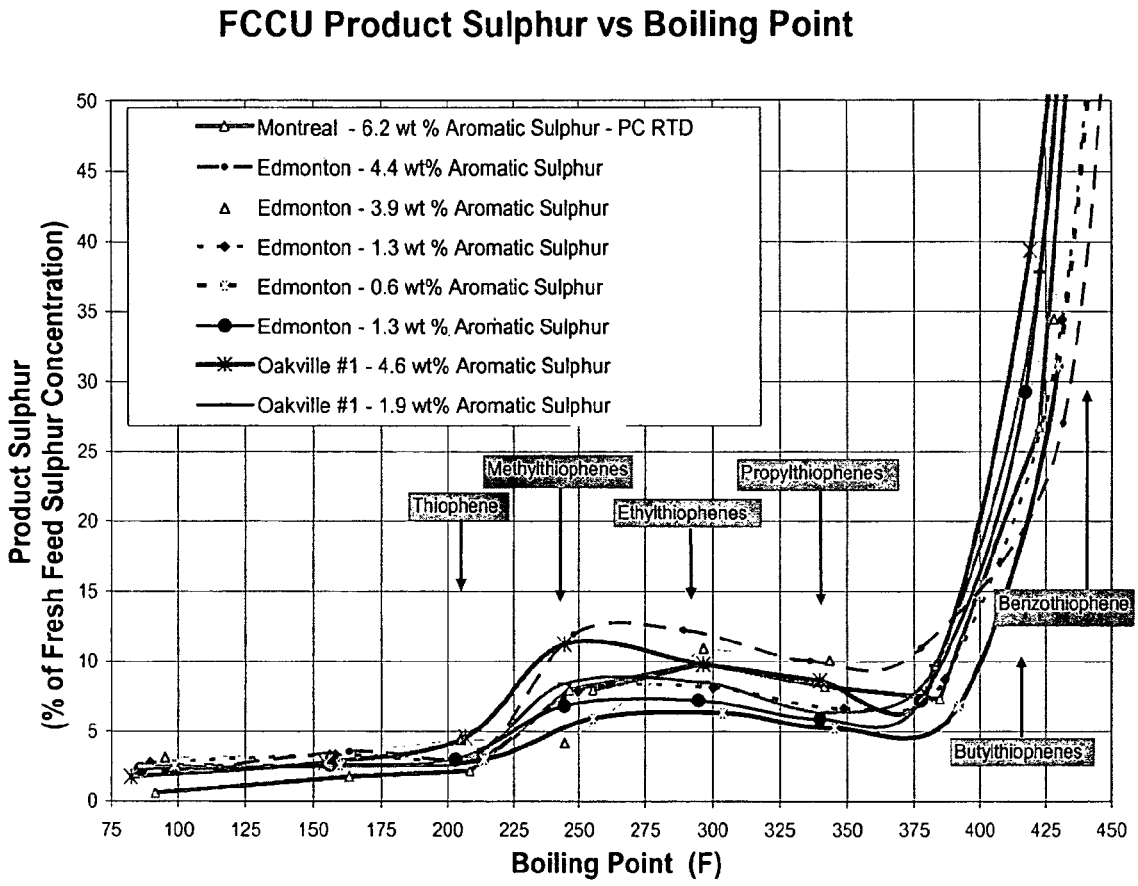
FIG. 2 is a graph of FCCU Product sulfur vs. Boiling Point with examples from three different locations.

FIG. 2 illustrates the sulfur profile obtained for a number of FCCU gasolines sampled from the three Petro-Canada refineries. The FCCU gasolines were cut in 45° F. cuts in a TBP column and characterized. The volumetrics, qualities and compositions reported represent the average for the individual 45° F. cut.

The data in FIG. 2 represents three different Petro-Canada FCCUs operating with variations in catalysts, hardware and operating conditions in 1999 and 2000. The bulk aromatic sulfur species content in the FCCU feedstock was used to differentiate the feedstock qualities to these operations and was determined by mass spec analysis.

FIG. 2 illustrates the three distinct sulfur distribution regions common to all the FCCU gasoline benchmarks. As has been well documented in the literature, the major concentration of sulfur is found in the back end of the gasoline boiling range and is contributed by the benzothiophenes. A sulfur peak is observed in the gasoline at about 257° F. The mid gasoline boiling range peak and the associated plateau between about 266° F. and 347° F. is due primarily to the alkylated thiophenes in the gasoline. The height of the sulfur peak at about 257° F. for a given FCCU, catalyst system and hardware configuration is a function of the aromatic sulfur species in the feedstock.

Figure 3:
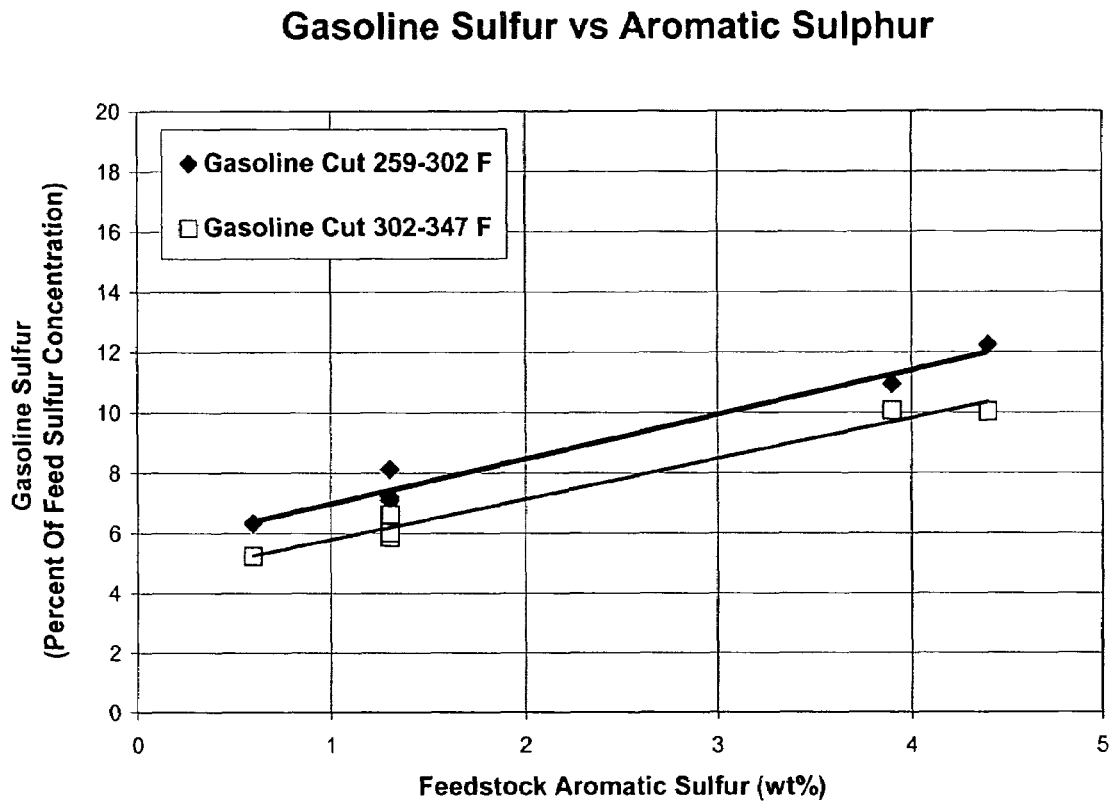
FIG. 3 is a graph of Gasoline sulfur vs. Aromatic Sulfur.

FIG. 3 shows the relationship between the aromatic sulfur species in the FCCU feedstock and the plateau heights for six sets of data from the Edmonton FCCU operation. There is a significant increase in gasoline sulfur as the amount of aromatic sulfur species of the feedstock is increased. The sulfur content of the FCCU gasoline boiling between 257° F. and 347° F. increases about 1.4% of feed sulfur concentration for every 1 wt % increase in the feedstock aromatic sulfur. The baseline operation represents a system with conventional hardware, a high zeolite conventional gasoil catalyst and feedstock blends comprised of virgin gasoils, delayed coker gasoils and slurry, and hydrocracker bottoms.

Benchmarking the four Petro-Canada FCCUs based on the aromatic sulfur criteria resulted in standardizing the catalyst systems to high alumina Albemarle Topaz type systems by mid 2002. Relative to the Edmonton baseline shown in FIG. 3, the Oakville #1 FCCU data for a similar low metals operation had sulfur gasoline benchmarks about 5% lower for a 1.5 wt % aromatic sulfur feedstock and 20% lower for a 4.6 wt % aromatic sulfur content feedstock. With the switch to the higher alumina Topaz system, the Edmonton FCCU gasoline sulfur dropped about 17% on a typical 3.5 wt % aromatic sulfur feedstock. These data are consistent with literature and illustrate the interaction of base catalyst design and feedstock aromatic sulfur content to gasoline sulfur.

As shown in FIG. 2, the Montreal FCCU gasoline with metals on equilibrium catalyst (ECAT) and PC RTD shows substantially lower gasoline sulfur throughout the gasoline boiling range. A large part of this sulfur reduction could be due to the much higher vanadium level on the Montreal catalyst. As shown in FIG. 1, another key factor could be the reduction for the opportunity of olefins to recombine and form mercaptans and thiophenes. This is in addition to the observation that the RTD generates less heavy boiling gasoline components.

Adding incremental sulfur directly to the riser in the form of $H_2S$ results in incremental sulfur being incorporated throughout the gasoline boiling range. Co-processing of sulfur containing species or $H_2S$ directly results in sulfur being incorporated into the FCCU products as shown in FIG. 1.

A test was run on the Petro-Canada Oakville #2 FCCU where about 30% more $H_2S$ was introduced into the riser relative to the amount of $H_2S$ generated by processing the feedstock. An overall increase in the mercaptans and thiophene sulfur species of about 30% was observed with a 12% increase in mercaptans, an 83% increase in thiophene and a 20% increase in alkylated thiophenes. These results suggest that the thiophene peak observed in FIG. 2 can be largely influenced by controlling both the amount of $H_2S$ and olefin in contact with the catalyst. This is consistent with elevated gasoline sulfur observed at elevated riser temperatures.

Hydrocarbon feedstocks undergo thousands of reactions within the FCCU. The 430° F.– product yielded is similarly independent of the feedstock. Petro-Canada has undertaken cracking studies on model compounds and observed that even various straight chain paraffin pure components generate the typical carbon number and specie distribution observed when processing conventional FCCU feedstocks. Similar results have been reported in the literature. There are variations in the product distribution based on hydrogen content and specific structures in the model compound cracked, but the cracking process approaches an equilibrium and the differences in the cracked products becomes less as the cracking process time is extended. Employing the concept that the FCCU process will move towards an equilibrium several studies were undertaken on the four commercial units.

As illustrated in FIG. 2, the highest sulfur concentration in the FCCU gasoline is in the 388° F.+ boiling range. The reprocessing of the back end of the gasoline through the FCCU typically results in the elimination of more than half of the sulfur from the net gasoline product without the addition of any other sulfur removal mechanism such as a gasoline sulfur reduction additive. The percentage of sulfur removed by this process is increased for feedstocks with low aromatic sulfur concentrations because the sulfur content in the back end of these gasolines represents a greater percentage of the total sulfur in the gasoline.

Integrated high naphtha (HN) reactor product recycle back into the cracking system has been tested on all four FCCUs. The cut point for the HN product recycle material has ranged from about 302° F. to 482° F. The recycle has been added ahead of, with and after the main feedstock injection point. The recycle has been blended with various other streams before reintroduction into the cracking system. A net recycle product has been withdrawn from the system.

HN recycle has been withdrawn with variations in the number of fractionation trays between the product recycle draw and the net gasoline product and cycle oil product. The number of fractionation stages between the various draw points influences the width of the cut recycled and the ability to fractionate out the heavier boiling sulfur species.

Since 2001, Petro-Canada has benchmarked RESOLVE® 750 on three of it's FCCUs, RESOLVE® 850 on one unit and RESOLVE® 950 on 3 FCCUs. The first commercial testing of the Albemarle RESOLVE® 950 system has been underway in the #1 FCCU at the Petro-Canada Oakville refinery since late 2003. The concentration of RESOLVE® 950 in the Oakville #1 FCCU has been stepped up over 2004 and maintained at 35 wt % in the fresh catalyst mixture since the end of June 2004 unit it was shut down in April 2005.

The desulfurization level achieved over and above the sulfur reduction obtained with the platform described above is very dependent upon the aromatic sulfur content of the FCCU feedstock. Extremely high levels of desulfurization are achievable with virgin feedstocks containing low levels of aromatic sulfur. Desulfurization levels for a typical sweet gasoil with an aromatic sulfur content in the feed of about 2 wt % will be about 82% with about 25% RESOLVE® 950 in inventory.

In contrast, virgin feedstocks that contain higher levels of aromatic sulfur and typically higher base sulfur levels will exhibit substantially lower desulfurization efficiencies. Typical gasoils processed from asphalt operations at the Oakville Refinery and operating with the same 25% RESOLVE® 950 would only exhibit about a 40% reduction in gasoline sulfur due to the RESOLVE® 950. The net desulfurization efficiency of the additive and the recycle platform would be about 71%.

Figure 4:
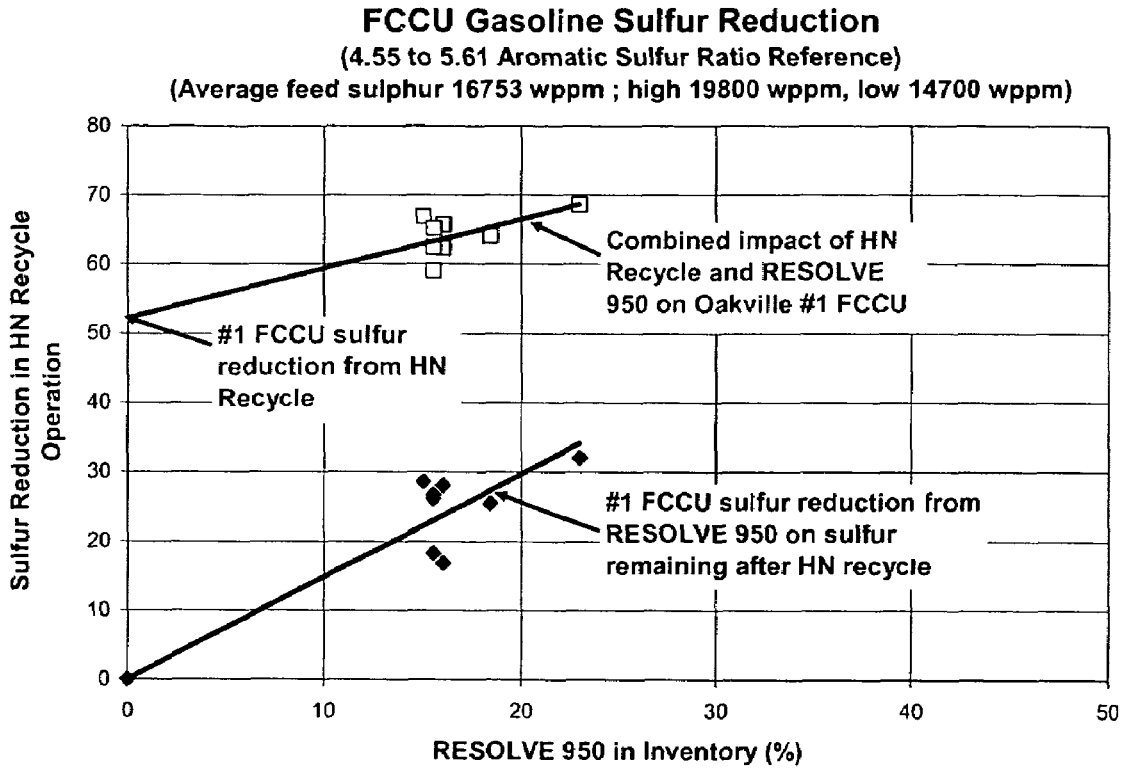
FIG. 4 is a graph of Gasoline Sulfur Reductions in HN recycle using different percentages of RESOLVE®.

FIG. 4 shows the data from the Oakville #1 FCCU processing asphaltic gasoil. The unit data covers blended feedstocks with aromatic sulfur concentrations ranging from 4.55 to 5.61 wt %. The average base sulfur reduction associated with the HN recycle platform for these feedstocks was 52 wt %. About 34% desulfurization was achieved with 24% RESOLVE® 950 on the remaining gasoline sulfur. The net desulfurization achieved in the commercial operation was 70% as indicated by the line showing the combined impact on FIG. 4. The effect of incremental RESOLVE® 950 in the unit inventory is linear for the range examined in the unit.

Figure 5:
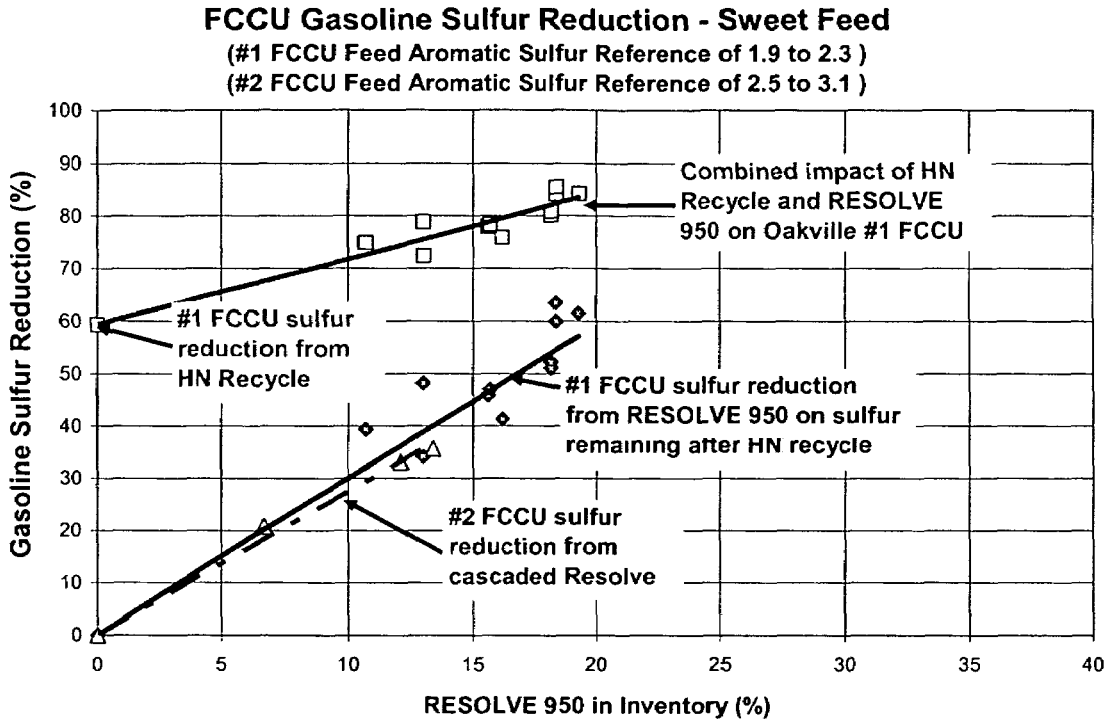
FIG. 5 is a graph of Gasoline Sulfur Reductions in Sweet Feed using different percentages of RESOLVE®.

FIG. 5 shows the data Oakville #1 FCCU processing primarily sweet gasoil. The Figure shows the base desulfurization associated with the HN recycle operation for the 2.1 wt % aromatic sulfur content average feedstock was about 60 wt %. An additional 60% desulfurization was achieved with 20% RESOLVE® 950 on the remaining gasoline sulfur. The net desulfurization achieved in the commercial operation was 85% as shown by the combined impact line on FIG. 5. As in the data set for the asphaltic gasoil, the effect of incremental RESOLVE® 950 in the unit inventory is linear for the range examined.

FIG. 5 also shows the data for the Oakville #2 FCCU processing a feedstock mix including vacuum topped bitumen (VTB). The majority of the RESOLVE) 950 in the Oakville #2 FCCU inventory has cascaded from the Oakville #1 FCCU unit. The desulfurization effect in this unit is also relatively linear with the desulfurization efficiency being slightly lower for the 2.7 wt % aromatic sulfur reference feedstock.

Figure 6:
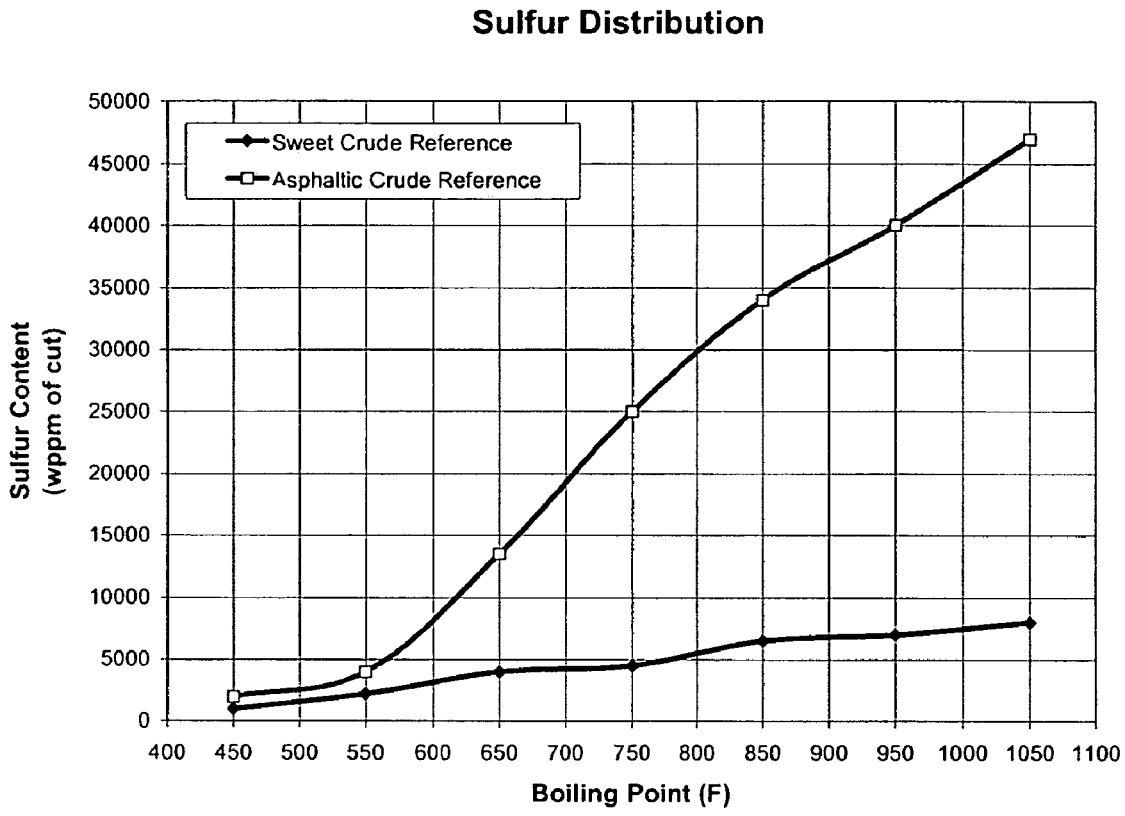
FIG. 6 is a graph of Sulfur Content vs. Boiling Point for Sweet Crude and Asphaltic Crude.

FIG. 6 shows the typical relationship for sulfur in virgin crude relative to boiling point for a paraffinic and an asphaltic crude benchmarks. The sulfur level of the asphaltic crude increases at a much faster rate than the sulfur in the sweet paraffinic crude.

Figure 7:
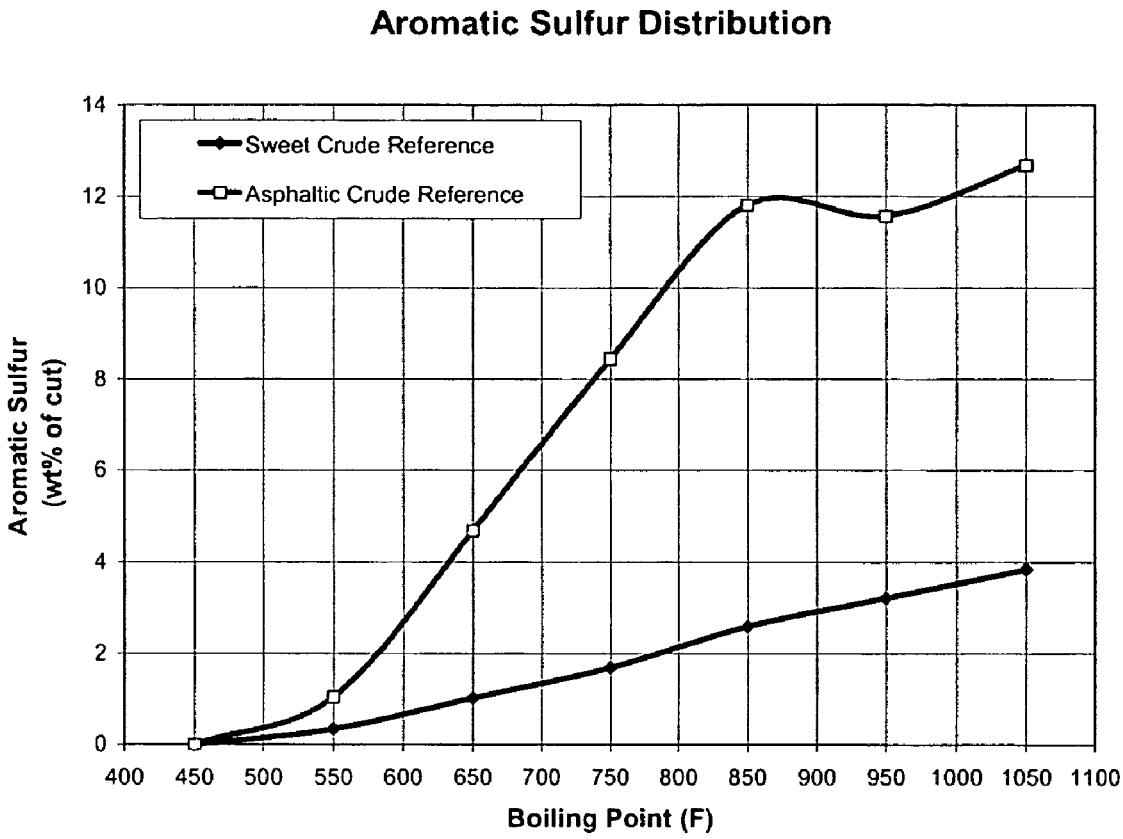
FIG. 7 is a graph of Aromatic Sulfur Content vs. Boiling Point for Sweet Crude and Asphaltic Crude.

FIG. 7 shows that the benchmark crudes exhibit a similar pattern for the aromatic sulfur content relative to boiling point Table 2 shows the range of typical feed qualities processed by the two FCCUs in the Oakville refinery. The feedstock precursors are defined by mass spectrometer molecular types. The gasoline precursors are calculated as the sum of the paraffins, cycloparaffins and monoaromatics in the feedstock. The two FCCUs tend to run at 430 F− conversion levels several percent higher than the gasoline precursor level in the feedstock with the unit 430 F− conversion increasing slightly as the average carbon number of the feed is decreased.

TABLE 2

Conventional FCCU Feedstock Properties at Oakville Refinery

| | Sweet Gasoil | Sweet VTB | Asphaltic Gasoil PG 64-22 | Asphaltic Gasoil Flux |
|---|---|---|---|---|
| Precursors (wt %) | | | | |
| Gasoline | 81.2 | 42.5 | 70.7 | 75.0 |
| LCO | 10.2 | 12.8 | 16.3 | 15.0 |
| Coke and Slurry | 8.6 | 44.7 | 13.0 | 10.0 |
| Average Carbon Number | 25.8 | 47.1 | 23.0 | 21.4 |
| Vol % boiling below 650 C. | 25.7 | 0 | 31.6 | 40.7 |
| Aromatic Sulfur (wt %) | 1.7 | 6.5 | 6.1 | 4.8 |
| Sulfur (wppm) | 4425 | 15800 | 22900 | 18300 |

The asphaltic gasoils contain a large component of 650 F− crude and have aromatic sulfurs in the range of that contained in the benchmark sweet crude VTB. The sweet gasoil has relatively low aromatic sulfur content at about 1.7 wt %. At the 150 wppm average gasoline pool specification, a large amount of asphaltic gasoil and sweet VTB can be processed.

Table 3 illustrates the result of blending 50/50 distillate and 650 F− gasoil from the benchmark sweet crude. Given an aromatic sulfur content of 1.2 wt %, and a net feed sulfur of 3592 wppm, a 50 wppm FCCU gasoline could be generated by dropping the gasoline sulfur to 1.4% of the feed sulfur. Based on the above desulfurization efficiencies, this could be accomplished with a 67% desulfurization efficiency from the RESOLVE® 950 using the above configuration. This would require about 20 wt % RESOLVE® 950 in the ecat when an octane barrel catalyst is used. Incremental amounts of RESOLVE® 950 allow for processing feedstock mixes with higher sulfur and aromatic sulfur content.

TABLE 3

POTENTIAL FCCU FEEDSTOCK BLEND

| | Sweet Gasoil | Sweet Distillate | Blend to 50% 650 F.- |
|---|---|---|---|
| Precursors (wt %) | | | |
| Gasoline | 81.2 | 93.6 | 85.3 |
| LCO | 10.2 | 6.0 | 8.8 |
| Coke and Slurry | 8.6 | 0.4 | 5.9 |
| Average Carbon Number | 25.8 | 15.8 | 22.5 |
| Vol % boiling below 650 F. | 25.7 | 100 | 50.0 |
| Aromatic Sulfur Ratio | 1.7 | 0.3 | 1.2 |
| Sulfur(wppm) | 4425 | 1886 | 3592 |
| Density | 0.89 | 0.83 | 0.87 |

Figure 8:
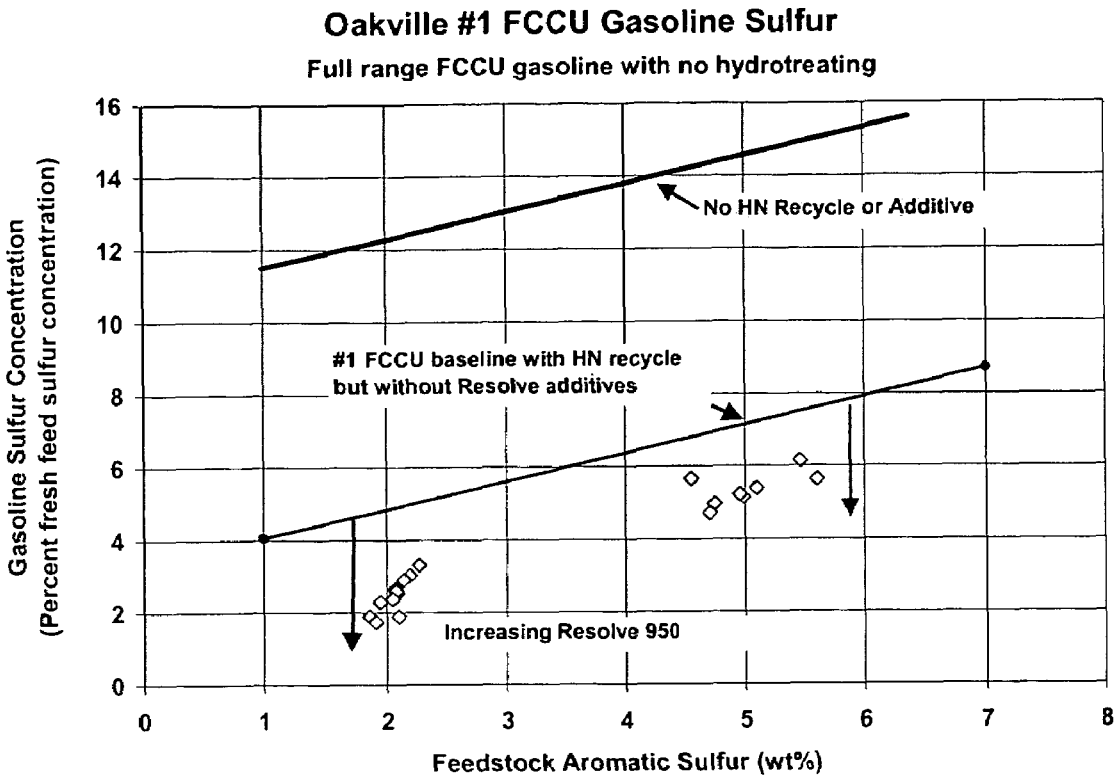
FIG. 8 is a graph of Gasoline Sulfur Concentration vs. Feedstock Aromatic Sulfur.

FIG. 8 shows the Oakville #1 gasoline desulfurization performance expressed as absolute sulfur in the full range gasoline. The low end of the data set for operation with low aromatic sulfur feeds reflects about 20 wt % RESOLVE® 950 in the ecat and an octane barrel host catalyst.

Table 4 compares synthetic crude components derived from tar sand and available from Syncrude in Fort McMurray to distillates from conventional crudes. The hydrotreated synthetic crude is low in both sulfur and aromatic sulfur. Similar to the blend of 50/50 sweet conventional crude distillate and gasoil discussed previously, yield similar to light sweet gasoil operation could be achieved. About 13% RESOLVE® 950 in ecat would be required to generate a 50 wppm sulfur content FCCU gasoline from this feedstock with the integrated system.

TABLE 4

NON-CONVENTIONAL FCCU FEEDSTOCK PROPERTIES

| | Syncrude 392 F.+ | Syncrude Gasoil 675 F.+ | Syncrude distillate 392-675 F. | Sweet distillate 400-650 F. | Asphaltic distillate 400-650 F. |
|---|---|---|---|---|---|
| Precursors (wt %) | | | | | |
| Gasoline | 80.2 | 70.4 | 90.9 | 93.6 | 89.3 |
| LCO | 12.1 | 17.6 | 6.1 | 6.0 | 9.0 |
| Coke and Slurry | 7.7 | 12.0 | 3.0 | 0.4 | 1.7 |
| Aromatic Sulfur (wt %) | 1.4 | 2.1 | 0.6 | 0.3 | 1.1 |
| Sulfur (wppm) | 1700 | 2700 | 500 | 1886 | 5127 |
| Carbon Number | 21.1 | 28.9 | 15.1 | 15.8 | 15.3 |
| Density | 0.914 | 0.932 | 0.895 | 0.834 | 0.869 |

The feed quality impact on coke yield in an FCCU can be expressed by the following equation: Coke on catalyst=A× time$^N$ where:

A=feedstock coking index

N=contact time factor

Figure 9:
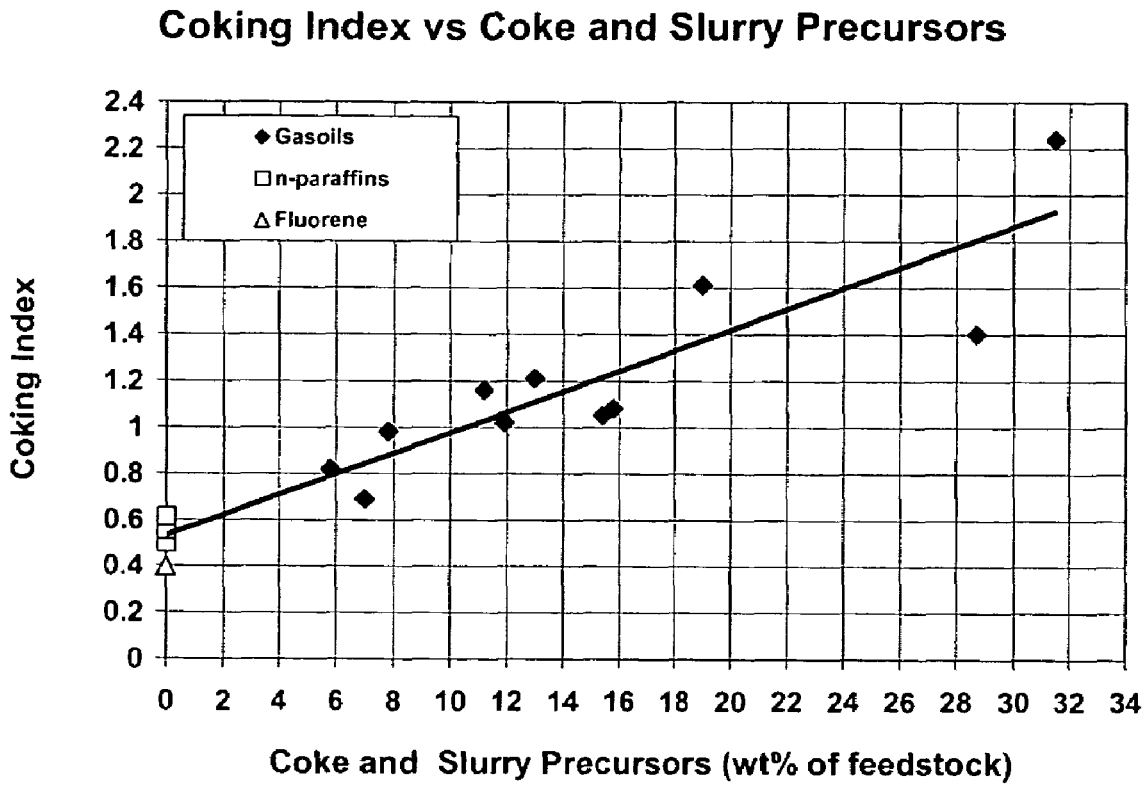
FIG. 9 is a graph of Coking Index vs. Coke and Slurry Precursors.

FIG. 9 shows the correlation between the coke and slurry precursors in the feed and the relative coking index achieved with an MAT reaction system. Adjusting the feedstock to the FCCU to generate a very low aromatic sulfur feedstock results in a substantial reduction in the feedstock coking index.

Figure 10:
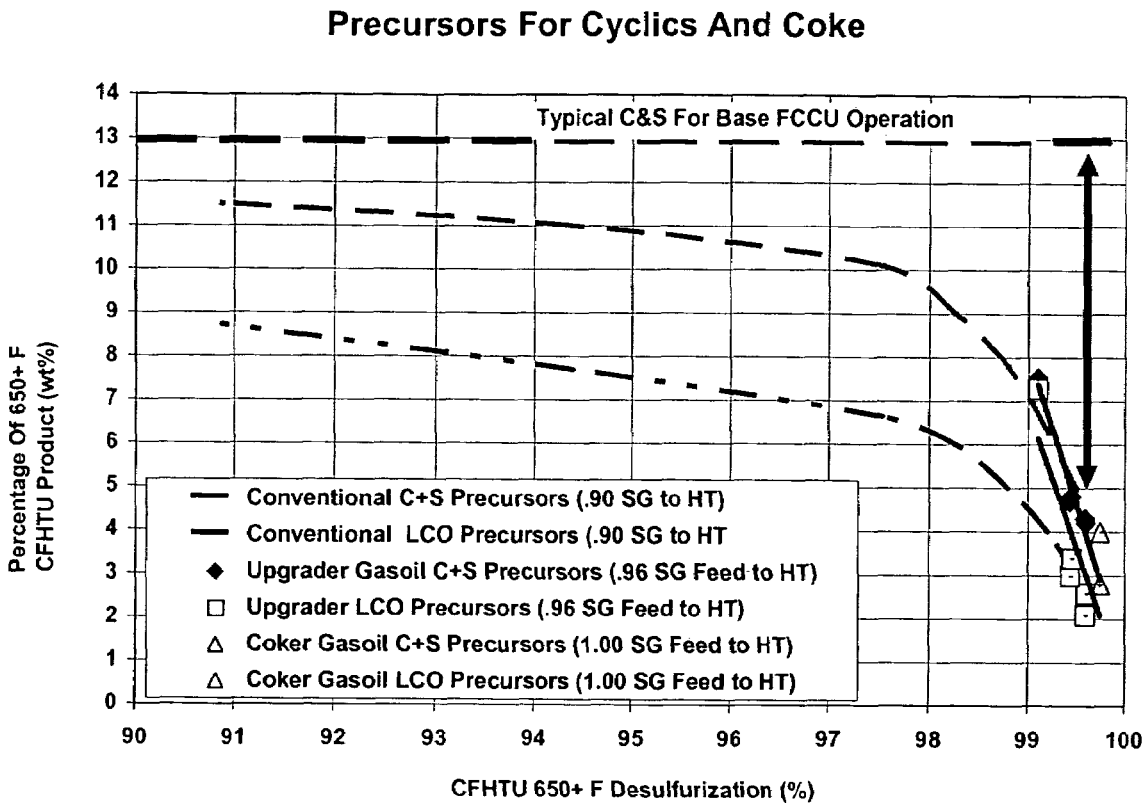
FIG. 10 is a graph of CFHTU products vs. CFHTU Desulfurization.

FIG. 10 indicates that as the hydrotreating severity is increased, the quantity of coke and slurry precursors is reduced for all operations examined. At desulfirization levels above 98%, there is a rapid drop off in the coke and slurry precursors for all feedstocks. This rapid drop off can result in both steady state heat balance issues as well as instability issues.

The low coking index of the low aromatic sulfur content feedstocks derived from virgin crudes or through high pressure hydrotreating of very poor feedstocks presents a significant problem for the FCCU heat balance. The coking index for these feedstocks could be a fraction of what is required to support the unit heat balance. Driving to very low sulfur concentrations in the CFHTU gasoil to facilitate the production of low sulfur distillate can create issues.

Figure 11:
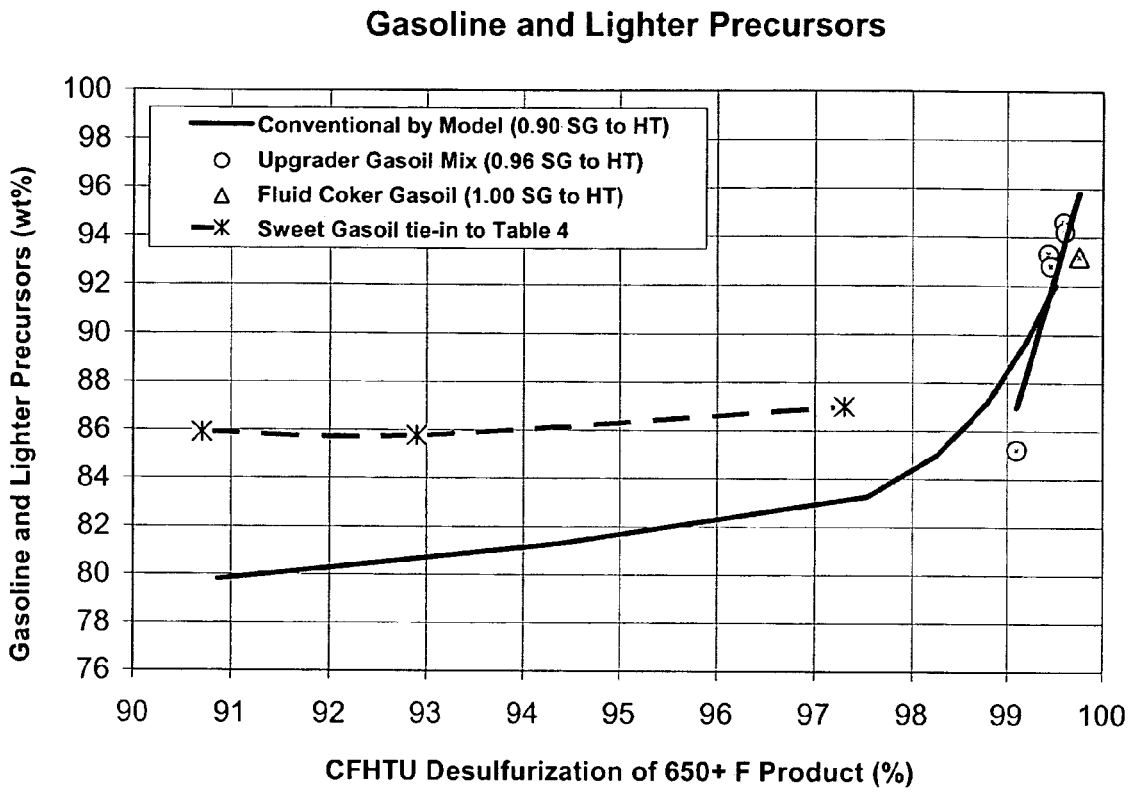
FIG. 11 is graph of Gasoline and Lighter Precursors vs. CFHTU Desulfurization of 650+F. Product.

FIG. 11 indicates that the migration to low aromatic sulfur feedstocks increases the gasoline precursors in the FCCU feedstock. At a given severity, the FCCU has to operate at higher conversion levels. Independent of feedstock source, the FCCU will produce very high conversion levels at high desulphurization rates. This could have a significant impact on downstream processing capability The present invention also has application to providing carbon distribution shifts with saturated $C_5$-$C_6$ co-processing. In accordance with the present invention, virgin crude or other heavier feedstock can be co-processed in the commercial FCCU with $C_5$-$C_6$s in order to preferentially take advantage of the FCCU product equilibrium. The present inventor has found this process particularly effective when used in conjunction with a product recycle process to the stripper described above. The percentage of $C_3$ and $C_4$'s generated from this kind of feedstock is similar to a base FCCU feedstock—only about 40% of the $C_5$'s and 31% of the $C_6$s remain in the 104-207° F. boiling range of the original feedstock. The yield profile shift obtained when co-processing the $C_5$-$C_6$s relative to that generated by the base feedstock alone provides higher carbon number structures in the gasoline with some additional LCO generated in the 446° F. range. This process thereby provides a mechanism to reduce net Reid Vapor Pressure (RVP) and increase the octane in the refinery gasoline pool.

DESCRIPTION OF THE PREFERRED EMBODIMENT

Attached as FIGS. 12*a*, 12*b*, 12*c* and 12*d* is an example of the slurry phase integration with the FCCU including the nitrogen adjusted for the distributor change in the CANMET unit, which can be used in the practice of the present invention. Referring to FIGS. 12*a*-12*d*, a bitumen or heavy crude 2 (having the characteristics set forth in FIG. 12*a*) is fed via a line 4 to a first stage preheat and desalter 6. The effluent from the desalter 6 in a line 8 then is fed to a fired preheater pitch kiln 10 (where it is heated by burning pitch bottoms from a line 12 obtained from a downstream vacuum unit 14). Bitumen ash and metals etc. are removed in clean hydrocarbon free ash for reclamation or sale as the solid product from the kiln at 16. The hydrocarbon feed exit the pitch kiln 10 in a line 18 and are fed to a prestripping column 20 to remove distillate. Distillate is removed out of the top of column 20 in a line 22, a portion of which can be removed in a line 24 as diluent recycle to be used a bitumen or heavy crude diluent, if required.

The distillate in line 22 is fed to a bulk hydroprocessor 26, which also is fed with distillate in a line 28 from a downstream pre-distillation unit 30. Hydrogen is supplied from hydrogen make-up 32 via a line 36. The hydroprocessed material is removed via a line 38 and directed to reformer 40 to produce reformed stream 42, where it is joined with a stream 44 from isomerizer 46, which isomerizes the lighter material in line 48 taken from the top of hydroprocessor 26. Stream 42 is then directed to the gasoline pool 50. Distillate product 52 is removed from the bottom of the hydroprocessor 26 via a line 54.

The bottoms from the prestripping column 20 are removed via a line 56 (joined with a line 58 comprising slurry bottoms from the FCCU fractionation tower 60 via a line 62 and a slip stream 64 from the hot high pressure separator 66) and fed to two parallel fired preheaters 68, 70 via lines 72, 74, respectively, for slurry reaction temperature control. Preheated streams 76 and 78 from preheaters 68 and 70, respectively, then are directed to CANMET Slurry Phase reactors 80 and 82, respectively (preferably with sizing described in FIG. 12*b*). Effluent from reactor 80 in a line 84 and effluent from reactor 82 in a line 86 are combined in a line 88 and quenched with quench line 90 and fed to hot high pressure separator 67. The CANMET reactor outlet lighter products and gas stream are removed from the top of the separator 67 in a line 92 and fed to a cold high pressure separator (112) through heat exchanger 140. The liquid from the cold high pressure separator (112) is then heated through heat exchanger 140 and fed to heater 94 before being fed via a line 96 to pre-distillation unit 30. Bottoms from the hot high pressure separator 67 in a line 98 are directed via a line 100 to the vacuum unit 14 or are directed via slip stream 66 described hereinabove. Pitch removed from the bottom of vacuum unit 14 is fed via a line 12 to fired preheater pitch kiln (described above). The distillate from vacuum unit 14 is directed via a line 102 to gasoil line 104 from the bottom of pre-distillation unit 30.

The overhead from pre-distillation unit 30 in a line 106 is fed to cold box 34 via a line 108. The vapour from the cold high pressure separator (112) is then split between the recycle gas routed to compressor 120 via line 116 and system purge to the cold box via line (122). The overhead vapour from cold box 34 in a line 110 is combined with hydrogen make up in a slip stream line 118. Bottoms from cold box 34 is sent to the bulk hydroprocessor 26 (in a line not shown). Recycled hydrogen rich gas in line 116 is directed to compressor 120, along with hydrogen stream 118 to produce compressed hydrogen stream 122, which is mixed with purge bottoms 124 from hydroprocessor 26 and fed to parallel fired preheaters (slurry reaction temperature controllers) 126, 128 via lines 130 and 132, respectively. Preheated effluent from preheaters 126 and 128 are fed to CANMET slurry phase reactors 80 and 82, respectively (described above) via lines 134 and 136, respectively.

Figure 12A:
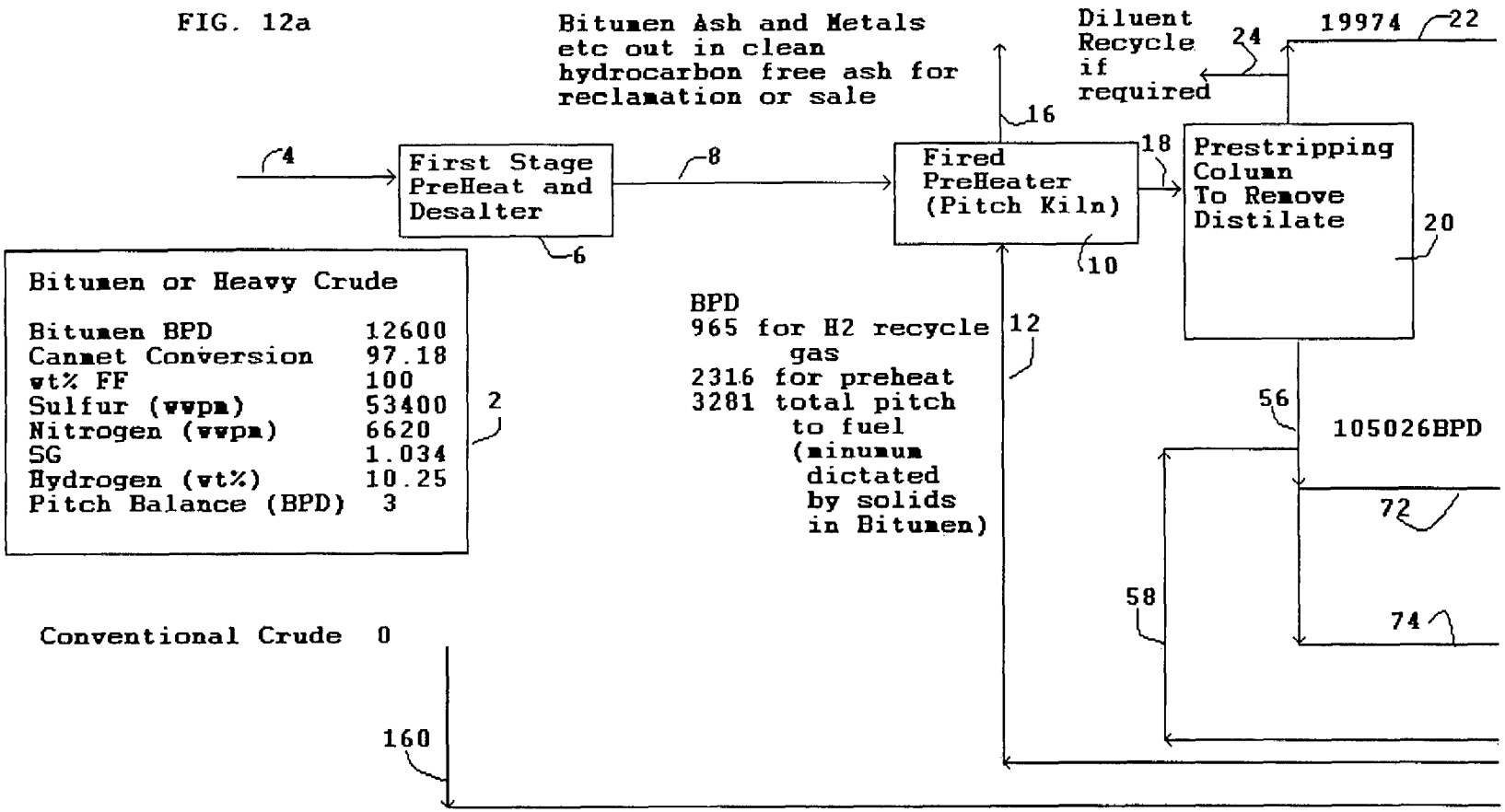
FIGS. 12*a-d* are a representation of the reaction pathways of one embodiment of the present invention.
Figure 12B:
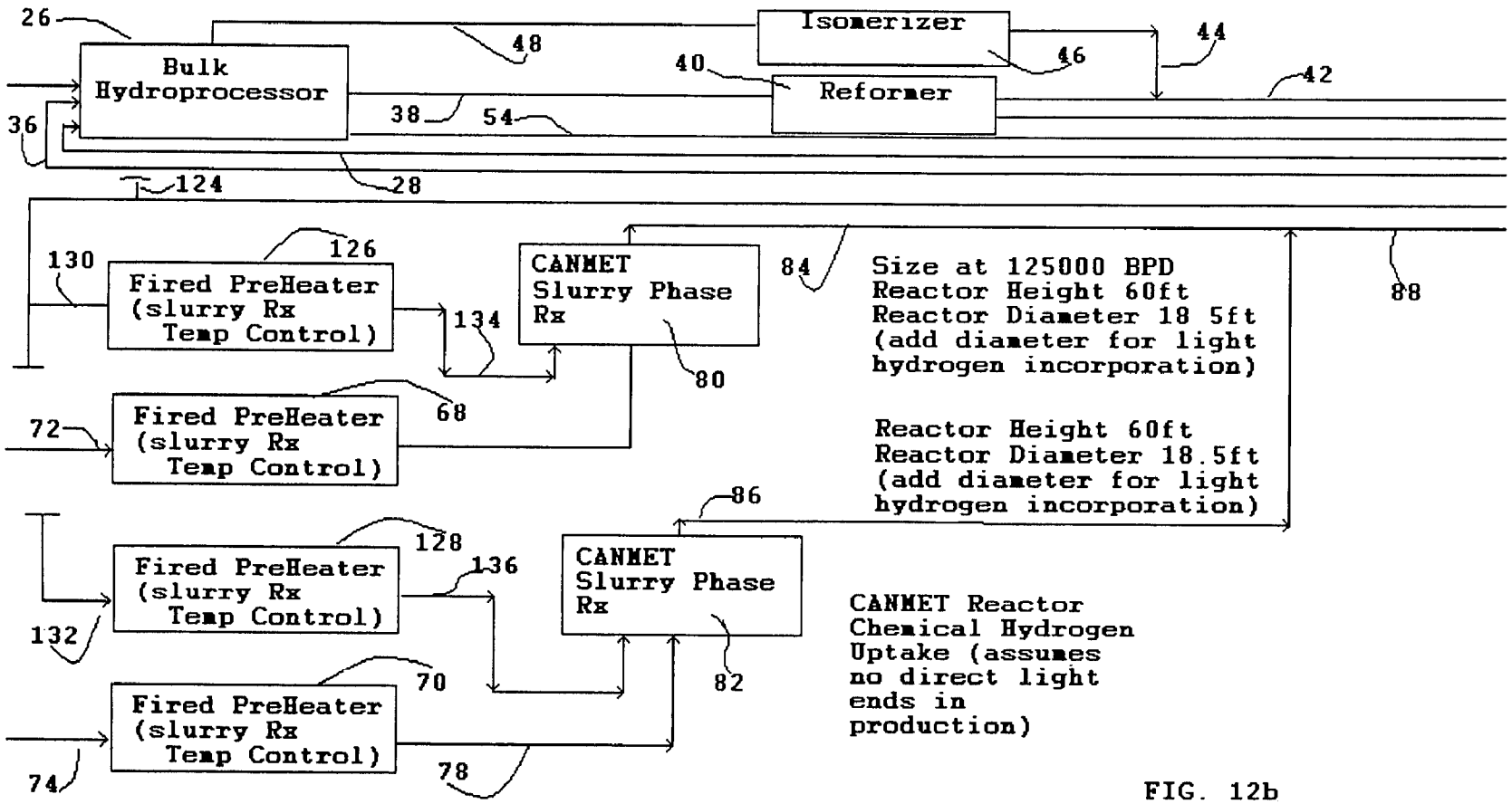
Figure 12C:
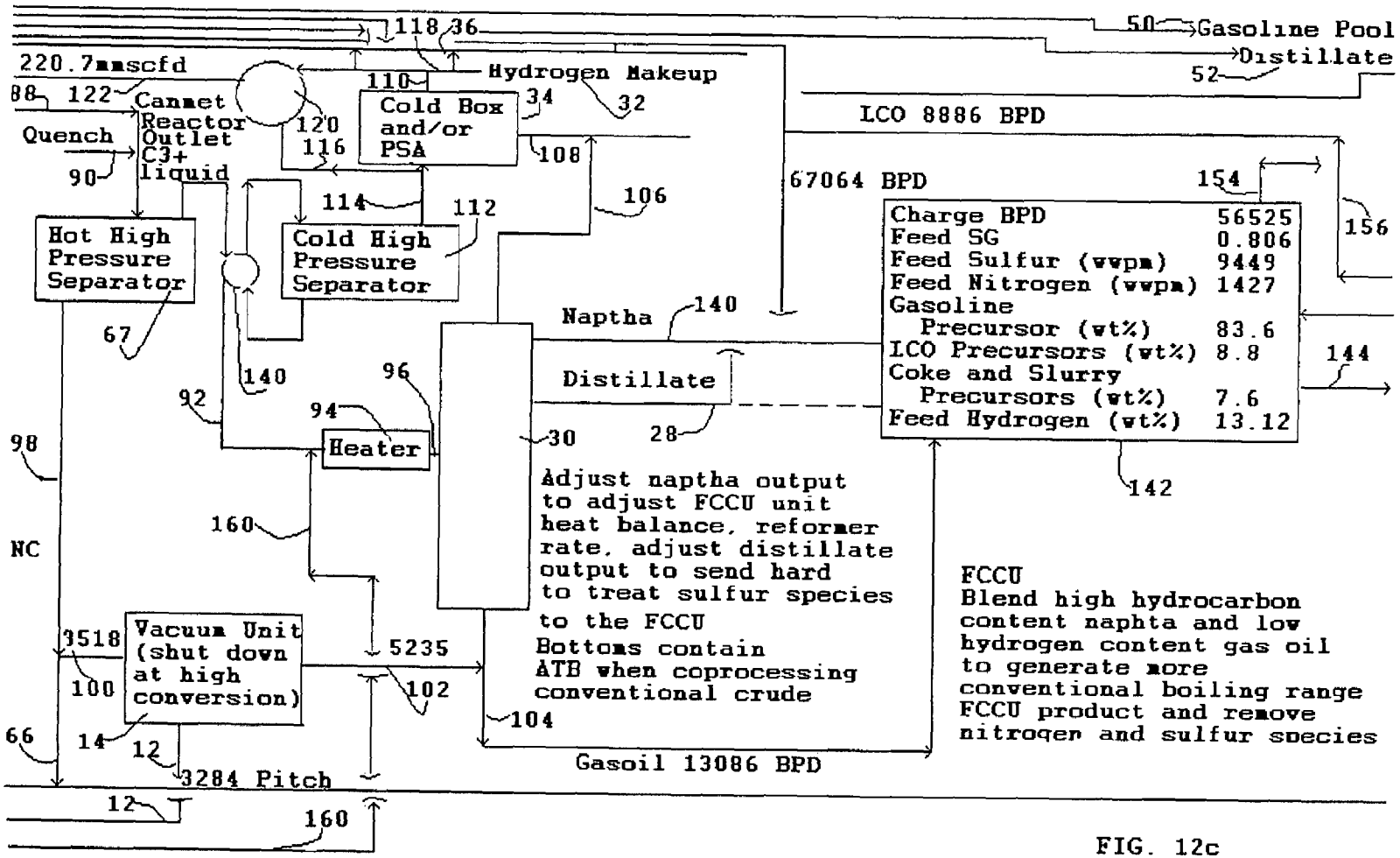
Figure 12D:
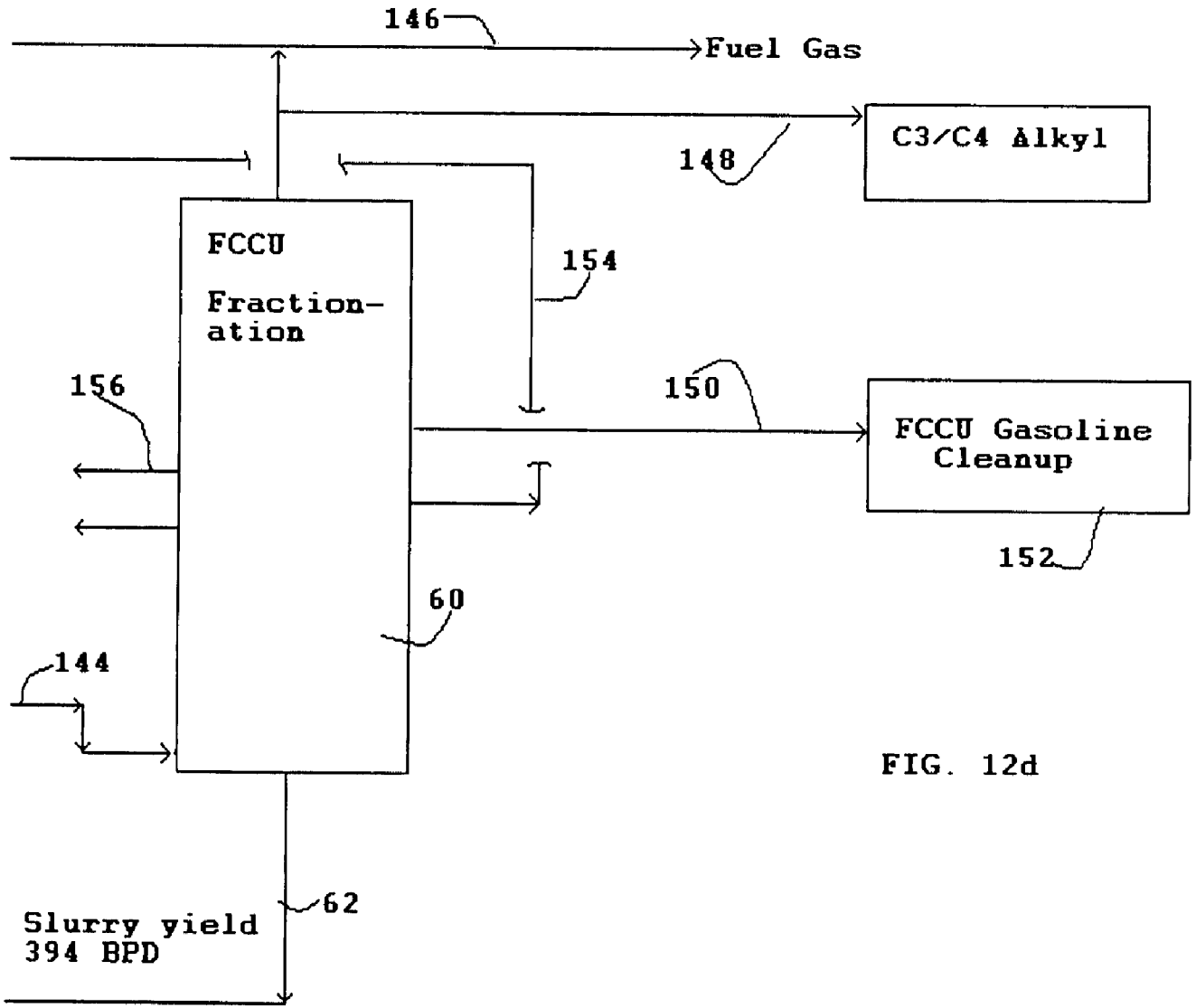

Naphtha 140 and gas oil 104 are combined in FCCU unit 142 (with representative combined feed composition shown in FIG. 12*c*). The naphtha output 140 from the pre-distillation unit 30 is adjusted to adjust the FCCU unit 142 heat balance and reformer rate. The distillate cutpoint 28 is adjusted to send hard to treat sulfur species to the FCCU unit 142. The bottoms of the pre-distillation unit 30 contain atmospheric tower bottoms when co-processing with conventional crude (described below).

In the FCCU unit 142, the feed is cracked to low content sulfur cracked products. The high hydrogen content naphtha from line 140 and low hydrogen content gas oil from line 104 are blended to generate a more conventional boiling range FCCU product and remove nitrogen and sulfur species. The product from the FCCU unit 142 is fed via a line 144 to FCCU fractionation unit 60, where the cracked products are separated into an overhead fuel gas line 146, and light olefins, light fuels and chemical feedstock. These are represented by generalized flows alkylate line 148, an FCCU gasoline line 150 (which is directed to FCCU gasoline cleanup 152) and a slurry bottoms line 62. Side draw line 154 is recycled to the FCCU unit 142. An LCO side draw line 156 also can be withdrawn and combined with distillate in line 28 from pre-fractionator 30.

In an optional embodiment, as discussed briefly above, a crude oil in a line 160 may be added to the heater 94 for heat balance purposes.

The FCCU Configuration as described in FIGS. 12*a-d* possesses the following advantages over the prior art:

1. Elimination of high boiling point heteroatoms from hydrotreater feed;
   a) protects fixed bed catalyst units;
   b) less capital required and more reliable;
   c) less cracking required therefore fewer saturated light hydrocarbons generated;
2. FCCU becomes the primary heteroatom removal system for the naphthas;
   a) generates naphtha with heretoatom concentration similar to conventional sweet gasoil operations;
3. RVP reduced due to molecular recombinations.
4. Less hydrogen required in the entire complex.
5. FCCU feedstock composition is conventional in terms of coke and slurry, Gasoline and LCO precursor concentrations.
6. Octane increased similar to installation of a straight run isomerization unit.
7. Conventional gasoline component mix generated (alkylate+olefins).
8. Can run either bitumen or sweet gasoil and can process simultaneously.
9. Can be set-up to generate no bottoms in complex.
10. CANMET 2 technology complementary;
    a) enables direct light end incorporation into heavy aromatics (benefits of not removing heaviest asphaltenes).
11. Very flexible.
12. Can shut down CANMET, FCCU and Hydrotreater sections of the complex independently.
13. Due to quality changes in the CANMET gasoil with conversion, the FCCU charge
    contains similar levels of tri+ aromatics over CANMET conversion range.
14. No practical limits on feedstock ash, metals or CCR equivalents;
    a) no need to position a pretreater or fractionation to remove "feed containments"
    b) clean ash goes to landfill or sale after being used as CANMET "catalyst"
    c) feed contaminants and low hydrogen content asphaltenes are effectively catalysts to this process;
    d) asphaltenes are more reactive and therefore easier to alkylate with light hydrocarbons;

e) generates more aromatic and inherently more stable CANMET reactor environment.

While certain preferred and alternative embodiments of the invention have been set forth for purposes of disclosing the invention, modifications to the disclosed embodiments may occur to those who are skilled in the art. Accordingly, the appended claims are intended to cover all embodiments of the invention and modifications thereof which do not depart from the spirit and scope of the invention.

All of the above-mentioned patents and publications are incorporated herein by reference.

I claim:

1. A process for providing reduced sulfur fuel and chemical feedstock products, said process comprising:

(a) cracking a hydrocarbon feedstock in a riser reactor in a fluid catalytic cracking unit in the presence of a cracking catalyst and a sulfur removal catalyst to produce a stream comprising cracked product and spent catalyst;

(b) separating said cracked product and spent catalyst in a separator comprising a separation unit for receiving said cracked product and spent catalyst, the separation unit comprising: (i) a substantially cylindrical internal downcomer pipe having an inlet, a downcomer portion having a vertical window located in a portion of said downcomer and a downcomer floor provided with a solids distribution plate; and (ii) a vapor outlet duct suitable for receiving gases from said vertical window and located concentrically outside said internal downcomer pipe and extending upwardly to produce a reduced sulfur cracked product stream and a spent catalyst stream;

(c) steam stripping said spent catalyst in a dense bed stripper;

(d) fractionating said reduced sulfur cracked product stream to produce at least a reduced sulfur gasoline stream, a reduced sulfur chemical feedstock stream and a reduced sulfur heavier than gasoline stream; and, (e) obtaining a heavy naphtha from said fractionation in step (d) and recycling said heavy naphtha to said riser reactor, wherein said process provides a net desulfurization of at least 70% of said fuel and chemical feedstock.

2. A process as defined in claim 1 wherein said hydrocarbon feedstock comprises a conventional fluid catalytic cracking feedstock selected from the group consisting of vacuum gas oils, atmospheric gas oils and mixtures thereof.

3. A process for providing reduced sulfur fuel and chemical feedstock products, said process comprising:

(a) cracking a hydrotreated heavy hydrocarbon feedstock in a riser reactor in a fluid catalytic cracking unit in the presence of a cracking catalyst and a sulfur removal catalyst to produce a stream comprising cracked products and spent catalyst;

(b) separating said cracked product and spent catalyst in a separator comprising a separation unit for receiving said cracked product and spent catalyst, the separation unit comprising: (i) a substantially cylindrical internal downcomer pipe having an inlet, a downcomer portion having a vertical window located in a portion of said downcomer and a downcomer floor provided with a solids distribution plate; and (ii) a vapor outlet duct suitable for receiving gases from said vertical window and located concentrically outside said internal downcomer pipe and extending upwardly to produce a reduced sulfur cracked product stream and a spent catalyst stream;

(c) steam stripping said spent catalyst in a dense bed stripper;

(d) fractionating said reduced sulfur cracked product stream to produce at least a reduced sulfur gasoline stream, a reduced sulfur chemical feedstock stream and a reduced sulfur heavier than gasoline stream;

(e) recycling a portion of said reduced sulfur heavier than gasoline stream to said dense bed stripper; and optionally, (f) obtaining a heavy naphtha from said fractionation in step (d) and recycling said heavy naphtha to said riser reactor, wherein said process provides a net desulfurization of at least 70% of said fuel and chemical feedstock.

4. A process as defined in claim 3 wherein said reduced sulfur heavier than gasoline recycle stream is selected from the group of heavy cycle oils, light cycle oils and mixtures thereof.

5. A process as defined in claim 4 wherein said reduced sulfur heavier than gasoline recycle stream comprises a light cycle oil.

6. A process as defined in claim 3 wherein said heavy hydrocarbon feedstock comprises a residual oil, bitumen, asphaltic crude or mixtures thereof.

7. A process as defined in claim 3 wherein said hydrotreating comprises hydrocracking.

8. A process as defined in claim 7 wherein said hydrocracking comprises slurry phase hydrocracking.

9. A process as defined in claim 1 wherein said hydrocarbon feedstock comprises a conventional fluid catalytic cracking feedstock in combination with a naphtha feedstock, an alkylate feedstock, a raffinate feedstock, a natural gas liquid feedstock, a distillate feedstock or mixtures thereof, and wherein said process further comprises recycling at least a portion of said reduced sulfur heavier than gasoline stream to said dense bed stripper.

10. A process as defined in claim 9 wherein said naphtha feedstock is obtained from an upstream fractionation.

11. A process as defined in claim 3 wherein said reduced sulfur heavier than gasoline recycle stream is selected from the group of coker gas oil, coker slurry, crude vacuum topped bitumen and mixtures thereof.

12. A process as defined in claim 11 wherein said reduced sulfur heavier than gasoline recycle stream is coker gas oil.

13. A process as defined in claim 11 wherein said reduced sulfur heavier than gasoline recycle stream is coker slurry.

14. A process as defined in claim 11 wherein said reduced sulfur heavier than gasoline recycle stream is vacuum topped bitumen.

15. A process as defined in claim 1 wherein said process provides a net desulfurization of at least 85% of said fuel and chemical feedstock.

16. A process as defined in claim 3 wherein said process provides a net desulfurization of at least 85% of said fuel and chemical feedstock.

* * * * *